United States Patent [19]

Swain

[11] Patent Number: 4,850,126

[45] Date of Patent: Jul. 25, 1989

[54] INDEXED SORTING SYSTEM

[75] Inventor: Horace E. Swain, Rose Bay, Australia

[73] Assignee: Swains Enterprises Pty. Ltd., Surry Hills, Australia

[21] Appl. No.: 38,520

[22] Filed: Apr. 15, 1987

[30] Foreign Application Priority Data

May 21, 1986 [AU] Australia ..... PH6009

[51] Int. Cl.[4] ..... B42F 17/22

[52] U.S. Cl. ..... 40/391; 40/534

[58] Field of Search ..... 40/391, 534, 434, 530

[56] References Cited

U.S. PATENT DOCUMENTS

| | | | |
|---|---|---|---|
| 1,043,365 | 11/1912 | Sea | 40/391 |
| 1,473,452 | 11/1923 | Welcker | 40/391 |
| 2,329,547 | 9/1943 | Lewis | 40/391 |
| 3,043,737 | 7/1962 | Engelstein | 40/534 |
| 3,159,931 | 12/1964 | Hopen | 40/530 |
| 4,294,029 | 10/1981 | Holson | 40/530 |
| 4,365,433 | 12/1982 | Buell | 40/534 |
| 4,400,899 | 8/1983 | Martinez | 40/391 |
| 4,441,270 | 4/1984 | Crowell et al. | 40/534 |

FOREIGN PATENT DOCUMENTS

| | | | |
|---|---|---|---|
| 38609 | 3/1887 | Fed. Rep. of Germany | 40/534 |

*Primary Examiner*—Gene Mancene
*Assistant Examiner*—Wenceslao J. Contreras
*Attorney, Agent, or Firm*—Fitch, Even, Tabin & Flannery

[57] ABSTRACT

A sorting system and leaf thereof for use im mailing and the like. The leaf is of a resilient plastic material of a generally rectangular shape and has a double hinge at one side to allow travel of the body of the leaf through approximately 180°. The leaf is attached to a base at a spine adjacent the hinge. A plurality of leaves attached to the base forms the sorting system.

7 Claims, 3 Drawing Sheets

INDEXED SORTING SYSTEM

BACKGROUND OF THE INVENTION

This invention relates to indexing systems, and in particular but not exclusively, to indexing systems which facilitate in the sorting of mail etc.

BACKGROUND OF THE PRIOR ART

The sorting of mail tends to be a job that must be performed by a human being, as opposed to a machine. This therefore requires manual handling of the papers which are to be sorted. One can either sort the papers directly onto a bench top or one can use an indexing system to help in collating. Such a system is known and is comprised of a board with a number of leaves attached thereto, these leaves define "pockets". It is into these pockets that the papers may be placed. The pockets may be divided into 31 days of the month, 7 days of the week, 12 months of the year, 26 letters in the alphabet, or any particular classification that is required. In general 31 pockets are provided an these have multiple classifications so as to make the one system versatile and appropriate for almost any use in the office and home.

However, the systems in use at the present have several disadvantages in both use and manufacture. In the manufacture thereof it has been common practice to make the leaves of a rigid cardboard and to individually print classification cards, insert these cards into holders and to then rivet the holders and cards to the leaves. This process is both time consuming, and labor and material extensive. The increased costs of manufacture must therefore be passed onto the consumer.

In use, problems have also been encountered in that the holders of the indexed cards tend to be bulky and have sharp corners which catch on anything from a finger nail to a piece of correspondence. Also, the materials of which the board, leaves and classification cards have been made of negates the possibility of providing a washable system if the need arises. Another problem is that due to the leaves being of a cardboard nature the bend/hinge tends to bias the system in the closed position making the filing of papers, especially a large number of papers, into the pockets towards the end of the system difficult. Another fault of using the cardboard materializes after a period of use. In this instance, as the leaves are attached to the base by means of staples, continued use results in the cardboard leaves tending to lift around the staple while leaving the staple in place.

SUMMARY OF THE INVENTION

It is therefore an object of the present invention to overcome or substantially ameliorate the abovementioned disadvantages.

In accordance with one broad form the present invention provides a leaf for a sorting system having a base to which is attached a plurality of the leaves arranged in cascade form, said leaf consisting of a body of generally planar configuration and being of a generally resilient plastic material, and an edge hinge portion to pivotally attach the leaf to said base, and wherein said hinge portion consists of two hinge lines which are generally parallel and spaced by a web, and are of reduced strength relative to said body.

In a preferred embodiment there is also provided on said leaves an indexing portion formed when an indent line is made in the leaf spaced from another side of said leaf, said indent having shoulders at either end to prevent the likelihood of a crack initiating along the indent. The indexing portion can run the whole length of the leaf or be an indexing tab spaced intermediate the ends.

BRIEF DESCRIPTION OF THE DRAWINGS

One embodiment of the present invention will now be described, by way of example only, with reference to the accompanying drawings in which.

DETAILED DESCRIPTION OF THE PREFERRED EMBODIMENT

Figure 1:
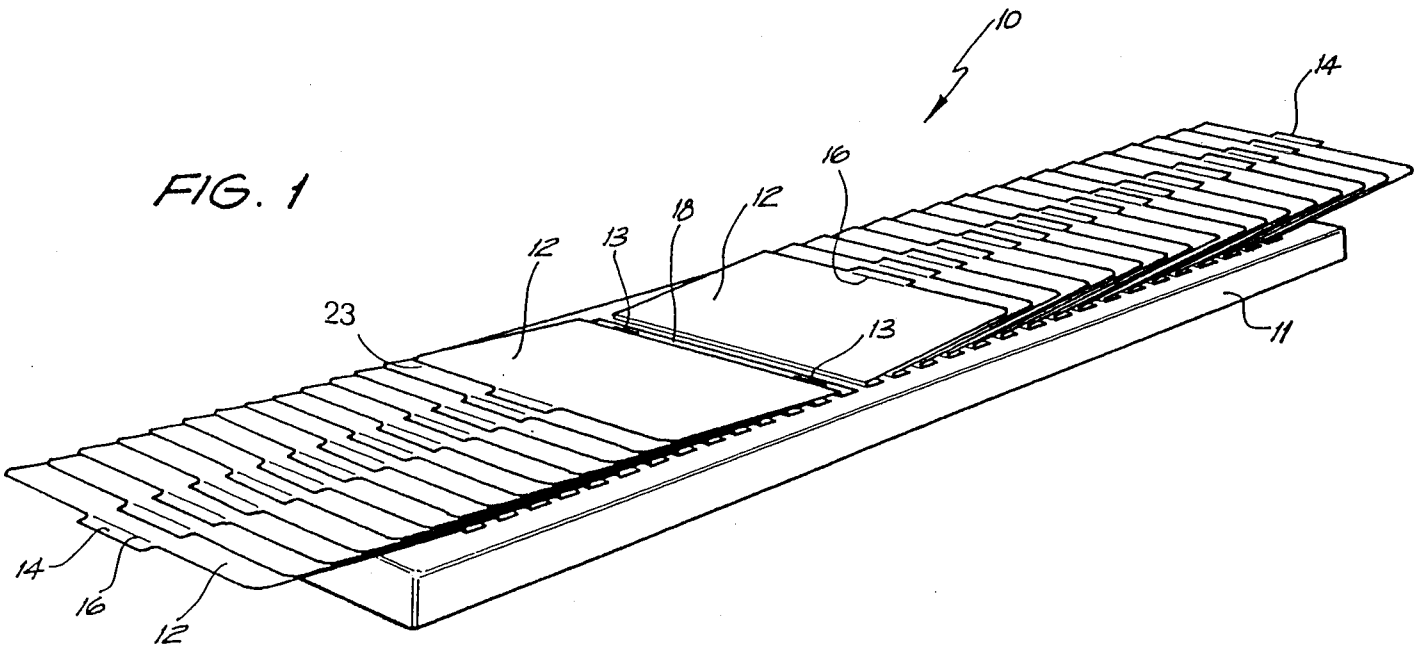
FIG. 1 is a perspective view of the indexed sorting system of the present invention, shown here in the half open position.
Figure 2:
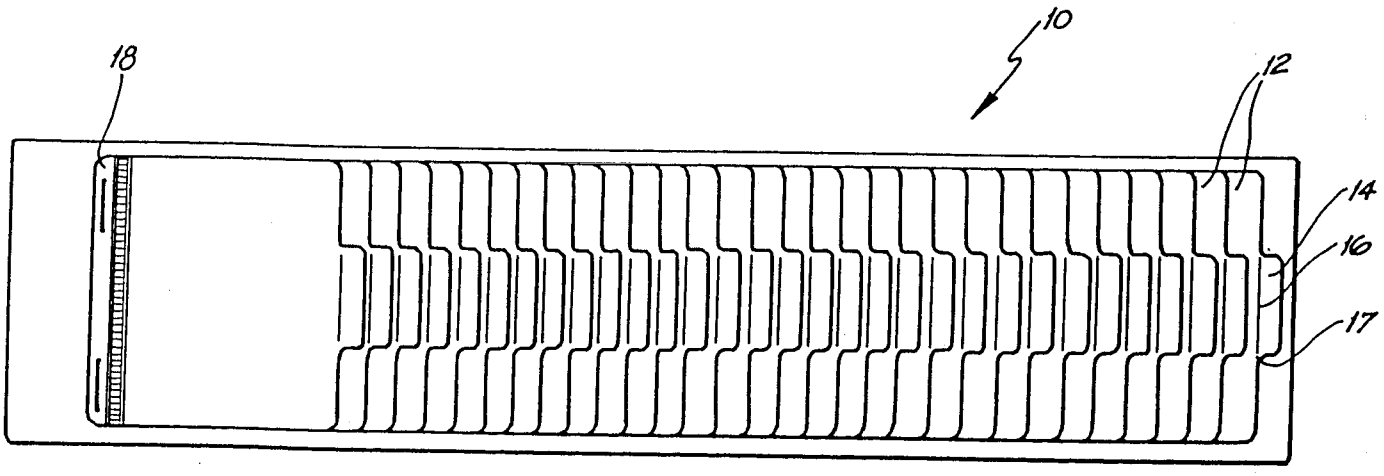
FIG. 2 is a plan view of one embodiment of the present invention, being in the fully closed position.
Figure 3:
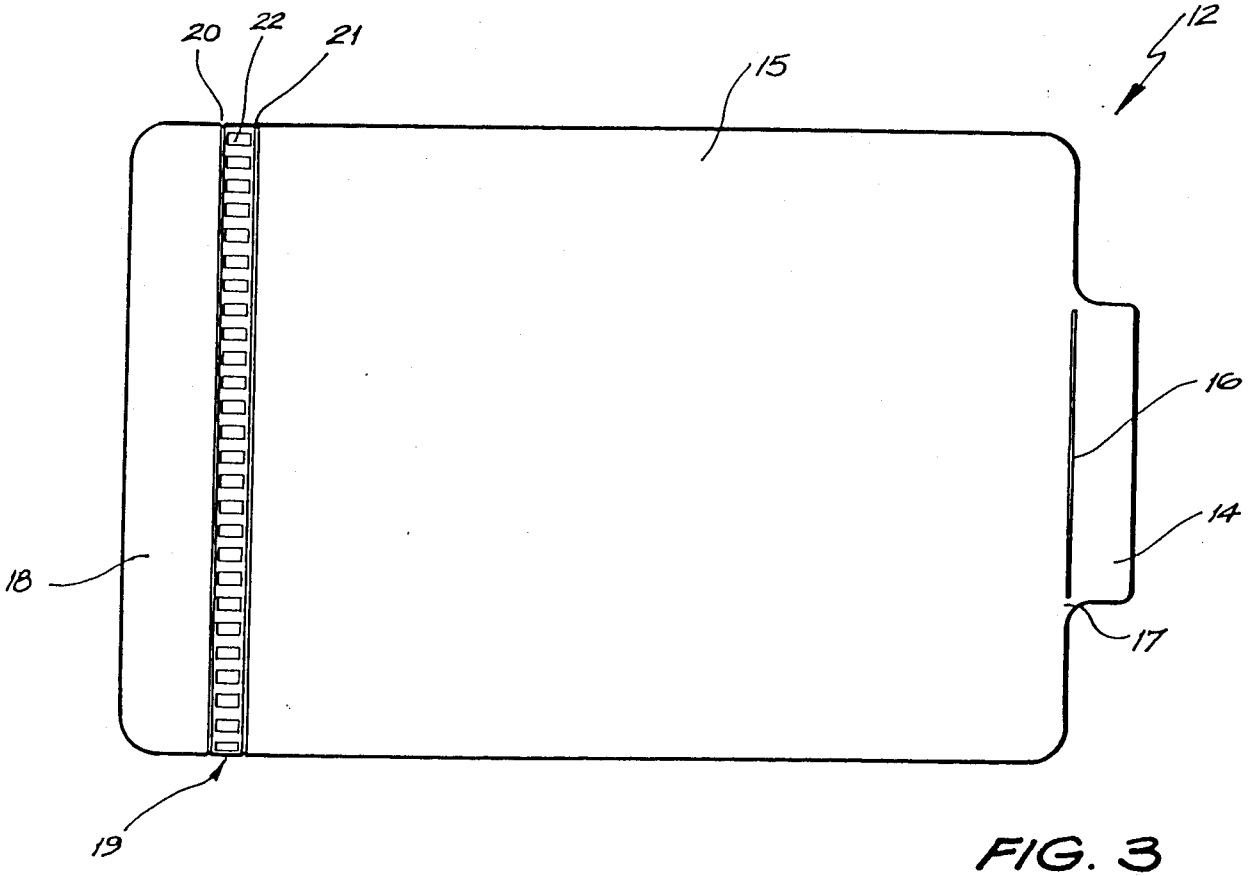
FIG. 3 is a view of a leaf used in the present ivention.

In FIG. 1 there is depicted an indexed sorting system 10 comprising a base 11 and a plurality of leaves 12. The base 11 is of a generally rectangular shape and may be made of any suitable material such as laminated particle board, molded plastics etc. Attached thereto are the leaves 12 which may be seen in greater detail in FIG. 3. The means by which the leaves 12 are attached to the base 11 is by staples 13. The leaves 12 are generally arranged in cascade form.

The leaves 12 are of a resilient plastic sheeting material and have the indexing portion 14 integrally molded therewith. This reduces the assembly, and therefore manufacturing costs. So as to give added differentiation to the indexing portion 14 from the main body 15 of the leaf 12 there is provided an indent 16, formed by such means as a cold press, between the body 15 and the indexing portion 14. It has been found that if this indent 16 is brought to the edges where the body 15 and the index portion 14 meet, there is formed a stress concentration. With continual use of the system the indexing portion 14 lifts somewhat out of the plane of the body 15, causing cracks to appear in the indent 16, which would eventually result in the indexing portion 14 being severed from the body 15. In this preferred form of the present invention the indent 16 is not brought to the edge of the join but is provided with shoulders 17 which thereby avoid the stress concentrations at the shoulder areas. This results in an increased strength and retention likelihood of the index portion 14. Furthermore, the index portion 14 of this embodiment is in the form of a tab spaced along and in the middle of the side 23.

The stapling fixture of the leaf 12 to the base 11 occurs as the spine 18 of the leaf 12. Provided adjacent the spine 18 is a double hinge joint 19 formed in the sheet, again by such means as a pressing action. Each hinge 19 is provided by two lines 20 and 21 of reduced thickness, joined by a web 22. The reduction in thickness of the material reduces the strength of the two lines 20 and 21. The hinge joints 19 are integrally formed with the remainder of the leaves 12. The double hinge 19 allows the leaf 12 to be raised through 90° to the spine 18 and then through another 90°, effectively moving 180° to its original orientation. This allows a plurality of leaves 12 to be "opened" so as to all lie at approximately 180° to their original setting, and to be retainable in this position until "flipped" back into position. Papers may now easily be sorted into the appropriate pocket which is formed between two adjacent leaves, without the fear of all the previous leaves 12 flipping back into their original, and biased, orientations.

The nature of the material used in forming the leaves 12 also helps in preventing the leaves 12 from breaking at the staples, and therefore lifting off the board completely.

It is envisaged that at the time when the leaves 12 are cut from the sheet material there will also be provided printing means by which the relevant classifications may be added to the index portions 14. Alternatively, the classifications may be left to the consumer.

It is also desirable that all the materials used in the manufacture of this system be of a washable nature.

The foregoing describes only one embodiment of the present invention and modifications, obvious to those skilled in the art, can be made thereto without departing from the scope of the present invention. For example, all edges may be rounded so as to avoid any injury or damage caused by sharp edges. Also, non-slip feet may be provided on the bottom of the base for ease in use. The width of the double hinge may also be increased or decreased, so as to allow more or less room for papers within the formed pockets. Furthermore, the leaves could be riveted to the base as opposed to stapled. It could also be advantageous if the indexing portions are provided with a hinge to allow the portions to be set in a plane other than that of the leaf without the fear of the portion breaking off entirely.

What I claim is:

1. A leaf for a sorting system having a base to which is attached a plurality of leaves arranged in cascade form, said leaf consisting of a body of generally planar configuration and being of a resilient plastic material, and an edge hinge portion to pivotally attach the leaf to said base, and wherein said hinge portion consists of two hinge lines which are generally parallel and spaced by a web, and are of reduced strength relative to said body whereby said hinge portion permits said leaf to be pivoted from an original closed position through 180° to an open position without the leaf springing back to said closed position.

2. A leaf according to claim 1 wherein said leaf is provided with an indexing portion, said portion formed when an indent is made along a side of said leaf to separate the portion from the leaf body.

3. A leaf according to claim 2 wherein shoulders are provided at both ends of the indent to prevent stress concentrations forming.

4. A leaf according to claim 3 wherein the indexing portion is only a fraction in length of the side on which it is formed.

5. A leaf according to claim 4 wherein indicia is printed on said indexing portion.

6. A sorting system having a base to which is attached a plurality of leaves according to claim 1 arranged in cascade form, wherein the base is of a generally rectangular shape and is of a rigid material such as wood or laminate.

7. A sorting system using a plurality of leaves according to claim 1 wherein the leaves are attached to the base by staples or rivets.

* * * * *